US006166355A

United States Patent [19]

Watanabe et al.

[11] Patent Number: 6,166,355

[45] Date of Patent: Dec. 26, 2000

[54] POWER-SAVING CONTROLLER FOR IMAGE-FORMING APPARATUS

[75] Inventors: Naoto Watanabe; Mitsuo Nimura, both of Kashiwa, Japan

[73] Assignee: Canon Kabushiki Kaisha, Tokyo, Japan

[21] Appl. No.: 09/188,315

[22] Filed: Nov. 10, 1998

[30] Foreign Application Priority Data

Nov. 14, 1997 [JP] Japan ..... 9-313443

[51] Int. Cl.[7] ..... H05B 1/02

[52] U.S. Cl. ..... 219/497; 219/492; 219/505; 219/216; 397/70; 397/94

[58] Field of Search ..... 219/494, 497, 219/492, 501, 505, 216; 399/36, 94, 70, 85, 88, 37, 28, 20

[56] References Cited

U.S. PATENT DOCUMENTS 4,719,489 1/1988 Ohkubo et al. ..... 355/14 FU
5,457,516 10/1995 Kim ..... 355/208
5,589,923 12/1996 Lee et al. ..... 399/28
5,681,493 10/1997 Yoshizuka et al. ..... 219/494
5,809,369 9/1998 Furuya et al. ..... 399/70

FOREIGN PATENT DOCUMENTS 59-201078 11/1984 Japan .
5-323710 12/1993 Japan .

*Primary Examiner*—Mark Paschall
*Attorney, Agent, or Firm*—Fitzpatrick, Cella, Harper & Scinto

[57] ABSTRACT

A power-saving controller for an image-forming apparatus activates a power-saving mode when the image-forming apparatus is operated with a power-saving key while standing by, and controls a fixer to have a target temperature selected by a user beforehand, which is lower than a target temperature of the fixer obtained when the image-forming apparatus stands by. After a predetermined period elapses, when the selected temperature is higher than a predetermined temperature, the power-saving controller controls the fixer to have the predetermined temperature.

18 Claims, 7 Drawing Sheets

*) A : FIRST POWER-SAVING TEMPERATURE
B : SECOND POWER-SAVING TEMPERATURE

*) A : FIRST POWER-SAVING TEMPERATURE
B : SECOND POWER-SAVING TEMPERATURE

POWER-SAVING CONTROLLER FOR IMAGE-FORMING APPARATUS

BACKGROUND OF THE INVENTION

1. Field of the Invention

The present invention relates to power-saving controllers for reducing power consumed when an image-forming apparatus stands by for image formation.

2. Description of the Related Art

There have been proposed a type of power-saving control in which a power-saving key for arbitrarily causing an image-forming apparatus to have a power-saving mode is pressed by a user so that the power-saving mode is activated, and another type of power-saving control in which no operation in a predetermined period automatically causes an image-forming apparatus to have a power-saving mode.

According to U.S. Pat. No. 5,681,493, when a power-saving mode is activated, a user can select a power-saving factor (the temperature of a fixing heater).

In U.S. Pat. No. 5,681,493, a selected low power-saving factor shortens a period needed for returning the temperature of a fixing heater to a temperature enabling image formation. However, there is a defect in that power saving is not effective when an image-forming apparatus is not used for a long time.

In other words, the function of selecting a power-saving factor by the user is not effectively used.

SUMMARY OF THE INVENTION

Accordingly, it is an object of the present invention to provide a power-saving controller and method in which the above-described defect is eliminated.

It is another object of the present invention to provide a power-saving controller and method capable of not only achieving the power-saving effects desired by a user but also enhancing the power-saving effects.

Other objects will become apparent from the following description of the preferred embodiment with reference to the attached drawings and the appended claims.

To these ends, according to an-aspect of the present invention, the foregoing objects have been achieved through the provision of a power-saving controller comprising:

temperature detection means for detecting the temperature of a heating load used in an image-forming apparatus;

temperature control means for controlling the driving of the heating load based on an output from the temperature detection means; a power-saving key for instructing transfer to a power-saving mode in which the heating load is controlled to have a temperature lower than a target temperature of the heating load obtained when the image-forming apparatus stands by; selecting means for manually selecting the target temperature of the heating load in the power-saving mode; and power-saving control means for controlling the temperature control means so that the heating load is controlled to have the target temperature selected by the selecting means when an instruction for performing transfer to the power-saving mode is input by the power-saving key, wherein when the target temperature selected by the selecting means is higher than a predetermined temperature, and a predetermined period elapses in the power-saving mode, the power-saving control means controls the heating load so that the heating load is controlled to have the predetermined temperature.

According to another aspect of the present invention, the foregoing objects have been achieved through the provision of a power-saving controller comprising:

temperature detection means for detecting the temperature of a heating load used in an image-forming apparatus;

temperature control means for controlling the driving of the heating load based on an output from the temperature detection means; selecting means for manually selecting a target temperature of the heating load in a power-saving mode in which the heating load is controlled to have a temperature lower than a target temperature of the heating load obtained when the image-forming apparatus stands by;

and power-saving control means for controlling the temperature control means so that when the image-forming apparatus is not operated in a predetermined period while not having the power-saving mode, the power-saving mode is activated, or when the target temperature selected by the selecting means is lower than a predetermined temperature, the heating load is controlled to have the selected target temperature, or when the selected target temperature is higher that the predetermined temperature, the heating load is controlled to have the predetermined temperature.

According to a further aspect of the present invention, the foregoing objects have been achieved through the provision of a power-saving control method comprising the steps of: (a) detecting the temperature of a heating load used in an image-forming apparatus; (b) controlling the temperature of the heating load based on the temperature detected in step (a); (c) determining whether or not an instruction to perform transfer to a power-saving mode is input, the power-saving mode being such that the heating load is controlled to have a temperature lower than a target temperature of the heating load obtained when the image-forming apparatus stands by; (d) storing the target temperature of the heating load in the power-saving mode, the target temperature being manually selected by an operator; (e) activating the power-saving mode when an instruction to perform transfer to the power-saving mode is input before controlling the heating load to have the selected target temperature; and (f) controlling the heating load to have a predetermined temperature when a predetermined period elapses in the power-saving mode, and the target temperature stored in step (d) is higher than the predetermined temperature.

According to a still further aspect of the present invention, the foregoing objects have been achieved through the provision of a power-saving control method comprising the steps of: (a) detecting the temperature of a heating load used in an image-forming apparatus; (b) controlling the temperature of the heating load based on the temperature detected in step (a); (c) storing a target temperature of the heating load in a power-saving mode in which the heating load is controlled to have a temperature lower than a target temperature of the heating load obtained when the image-forming apparatus stands by, the target temperature being manually selected by an operator; and (d) activating the power-saving mode when the image-forming apparatus is not operated in a predetermined period while not having the power-saving mode, and performing control so that when the target temperature stored in step (c) is lower than a predetermined temperature, the heating load is controlled to have the stored target temperature, or when the target temperature stored in step (c) is higher than the predetermined temperature, the heating load is controlled to have the predetermined temperature.

DESCRIPTION OF THE PREFERRED EMBODIMENT

One embodiment of an image-forming apparatus according to the present invention will be described below with reference to the attached drawings.

Figure 1:
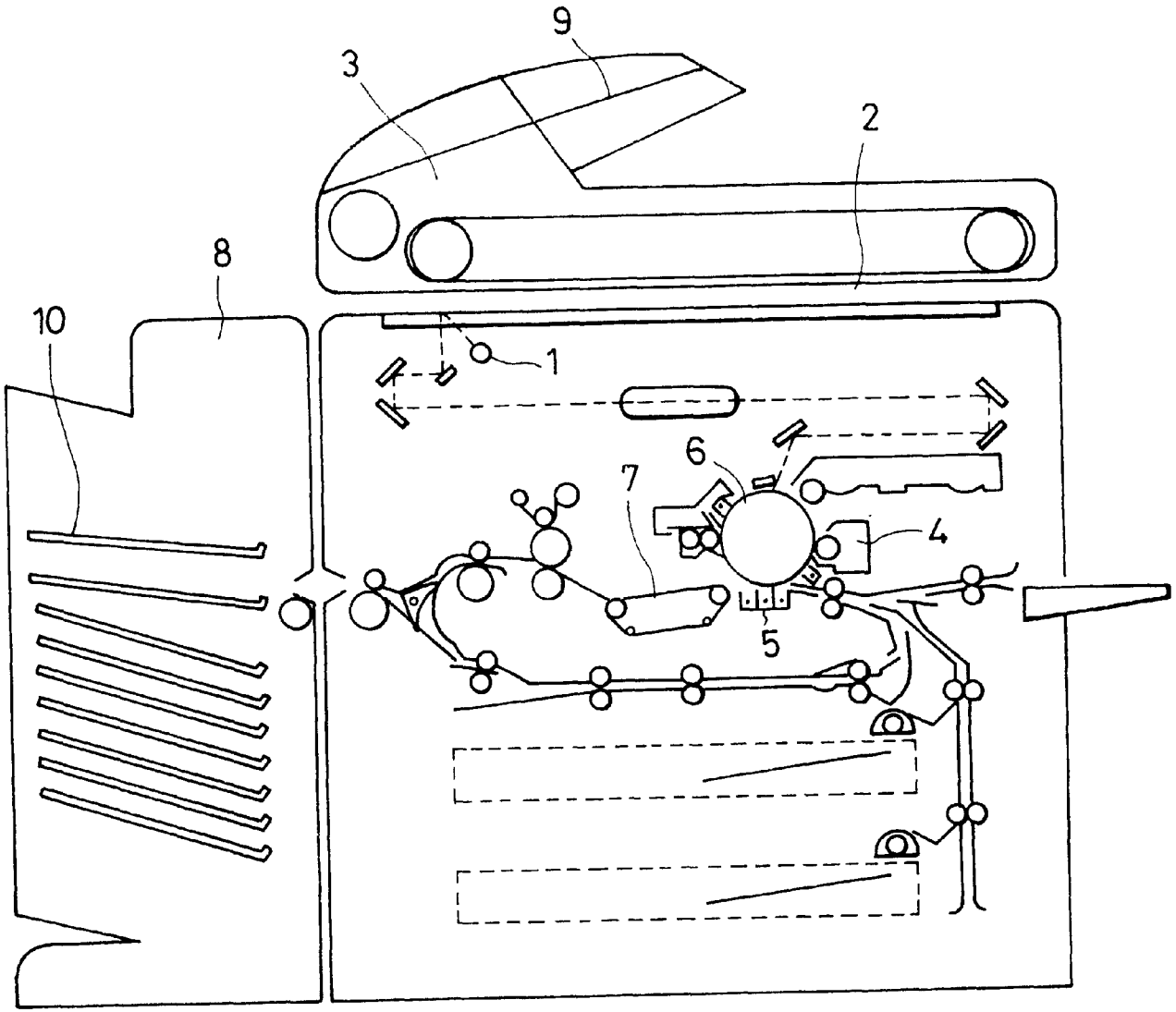
FIG. 1 is a schematic section view showing the structure of an image-forming apparatus.

FIG. 1 shows the schematic internal structure of an image-forming apparatus to which the present invention can be applied. The image-forming apparatus includes a document-illuminating lamp 1, a document-table glass 2, an automatic feeder 3, a developer 4, a transfer-separation charger 5, a photosensitive drum 6, a fixer 7, a sorter 8, a document tray 9, and a discharging tray 10.

A document set on the-document tray 9 is fed onto the document-table glass 2 by the automatic feeder 3 before being illuminated by the document-illuminating lamp 1, and the reflected light image forms an electrostatic image on the photosensitive drum 6. The electrostatic image (electrostatic latent image) is processed to become a visible image by the developer 4 using toner composed of resin that is softened and melted by heat.

The toner image is transferred onto recording paper by the transfer-separation charger 5, and is heated to be fixed by the fixer 7. Subsequently, the recording paper is discharged to the discharging tray 10.

The automatic feeder 3 includes a sensor for detecting documents on the document tray 9. With documents set in the document tray 9, in the case where the sensor detects no document when the first document is fed onto the document-table glass 2, the sensor finds that the number of documents is one. In the case where the sensor detects no document when the second document is fed onto the document-table glass 2, the sensor finds the number of documents is two.

Figure 2:
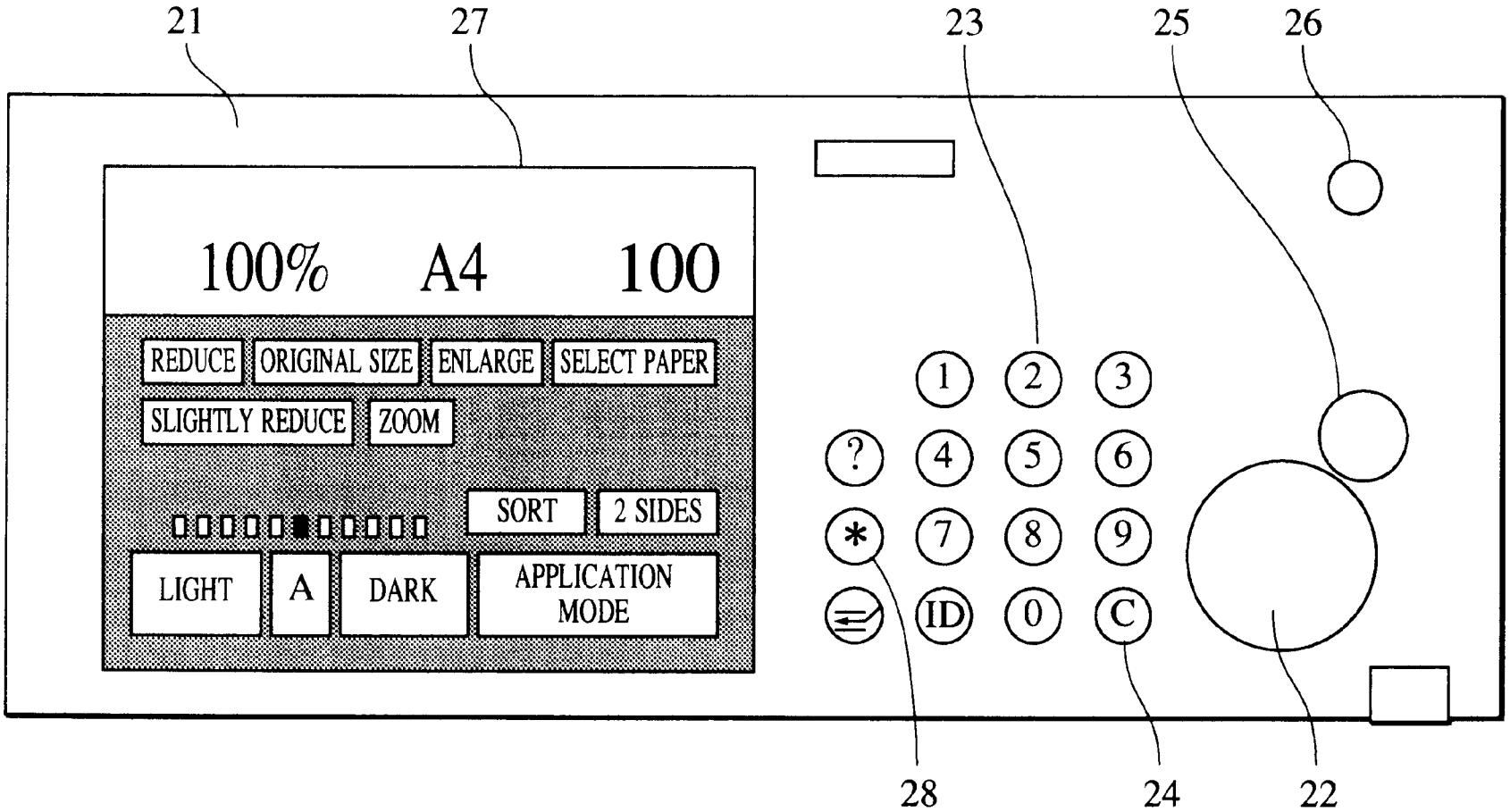
FIG. 2 is a front view showing an operation unit.

FIG. 2 shows a schematic view of an operation unit 21 for the image-forming apparatus shown in FIG. 1. A start key 22 instructs the start of operation. A ten-key portion 23 sets the number of images to be formed. The number of times of image formation with respect to the number of images set at 1 can be 1, 2, or more in accordance with the operation mode of the image-forming apparatus. A clear key 24 clears a value set with the ten-key portion 23. A stop key 25 stops image formation. A power-saving key 26 (described below) has a built-in light-emitting diode (LED) that flashes orange when the power-saving key 26 is pressed.

A touch-panel display device 27 displays the value set by the ten-key portion 23, and its touch-panel operation keys are used to set an operation mode, a paper size, and a magnification.

A user key 28 is used to call up a user mode in which the user can perform various setting. By pressing the user key 28, a user-mode window 30 is displayed in the touch-panel display device 27.

Figure 3:
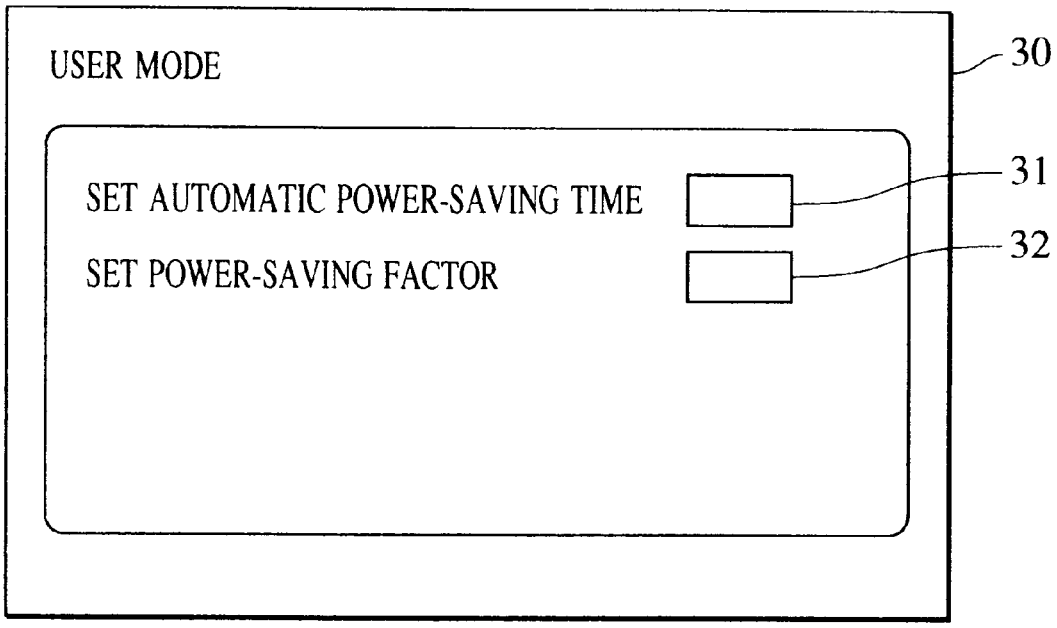
FIG. 3 is a drawing showing a user-mode screen.

FIG. 3 shows the user-mode window 30. By pressing a timer-setting key 31, a window for setting a power-saving-mode period for transfer to a power-saving mode by a second power-saving unit (described below) is displayed.

By pressing a power-saving-factor setting key 32, a window in which the user can arbitrarily select a power-saving temperature used in a power-saving mode activated by a first power-saving mode unit (described below) is displayed.

Figure 4:
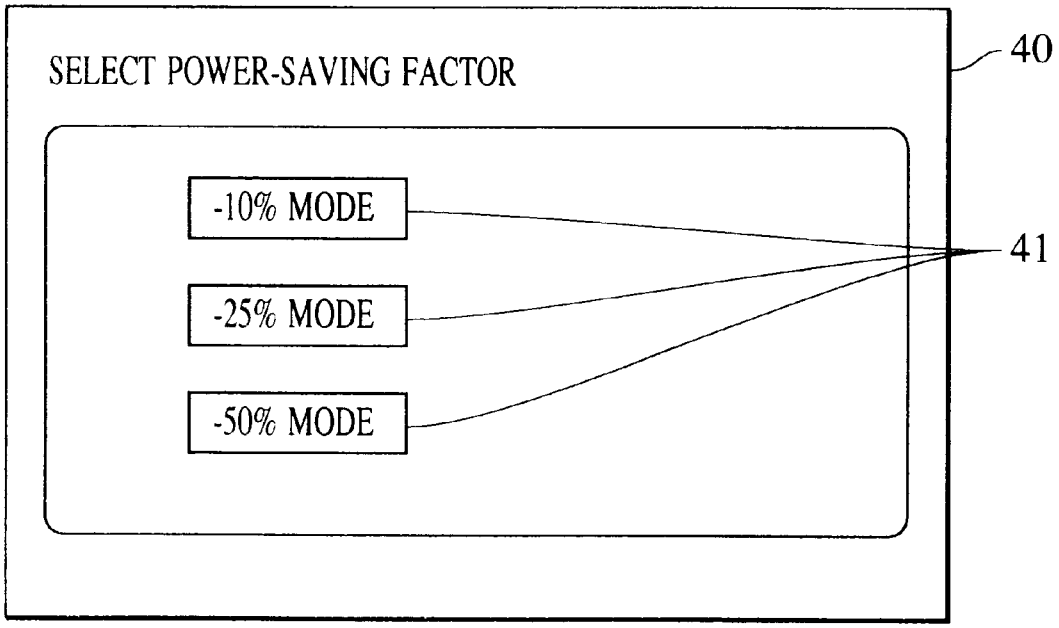
FIG. 4 is a drawing showing a power-saving-factor setting screen.

FIG. 4 shows a power-saving-factor setting window 40. The power-saving-factor setting window 40 includes power-saving-factor setting keys. corresponding to power-saving efficiencies. As the power-saving percentage increases, the power-saving efficiency rises. A first power-saving temperature is set to be low.

Figure 5:
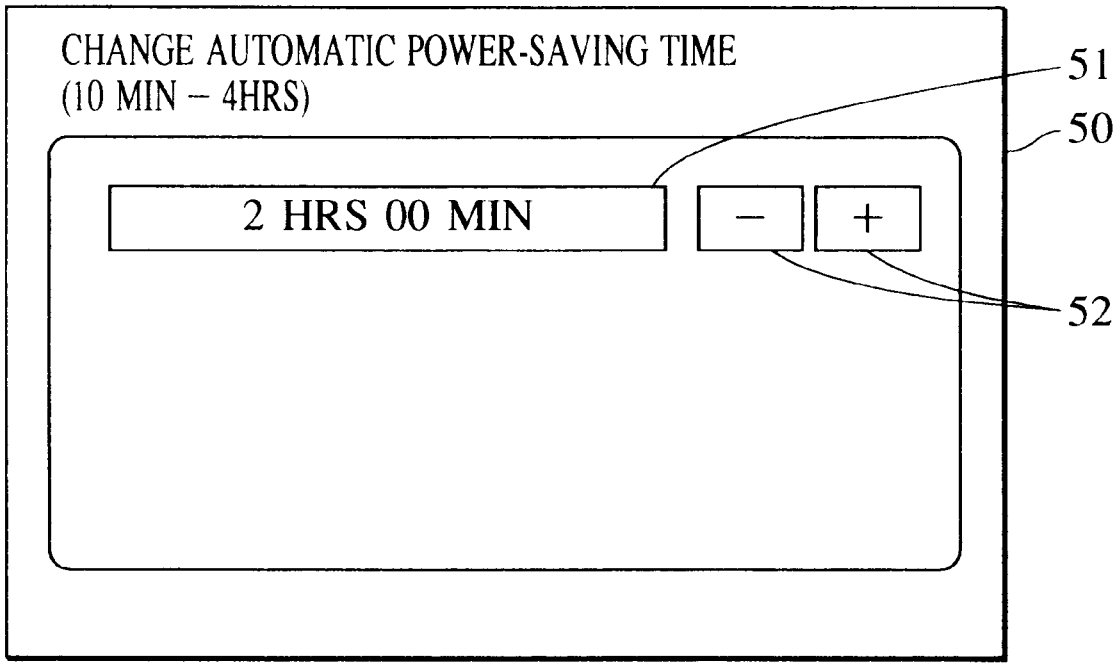
FIG. 5 is a drawing showing a power-saving-timer setting screen.

FIG. 5 shows a power-saving-timer setting window 50. The power-saving-timer setting window 50 includes a power-saving-mode time display 51, and power-saving-mode-time setting keys 52 for increasing or reducing the time displayed on the power-saving-mode time display 51.

The set power-saving factor and power-saving-mode time are stored in a controller 61 (described below).

Figure 6:
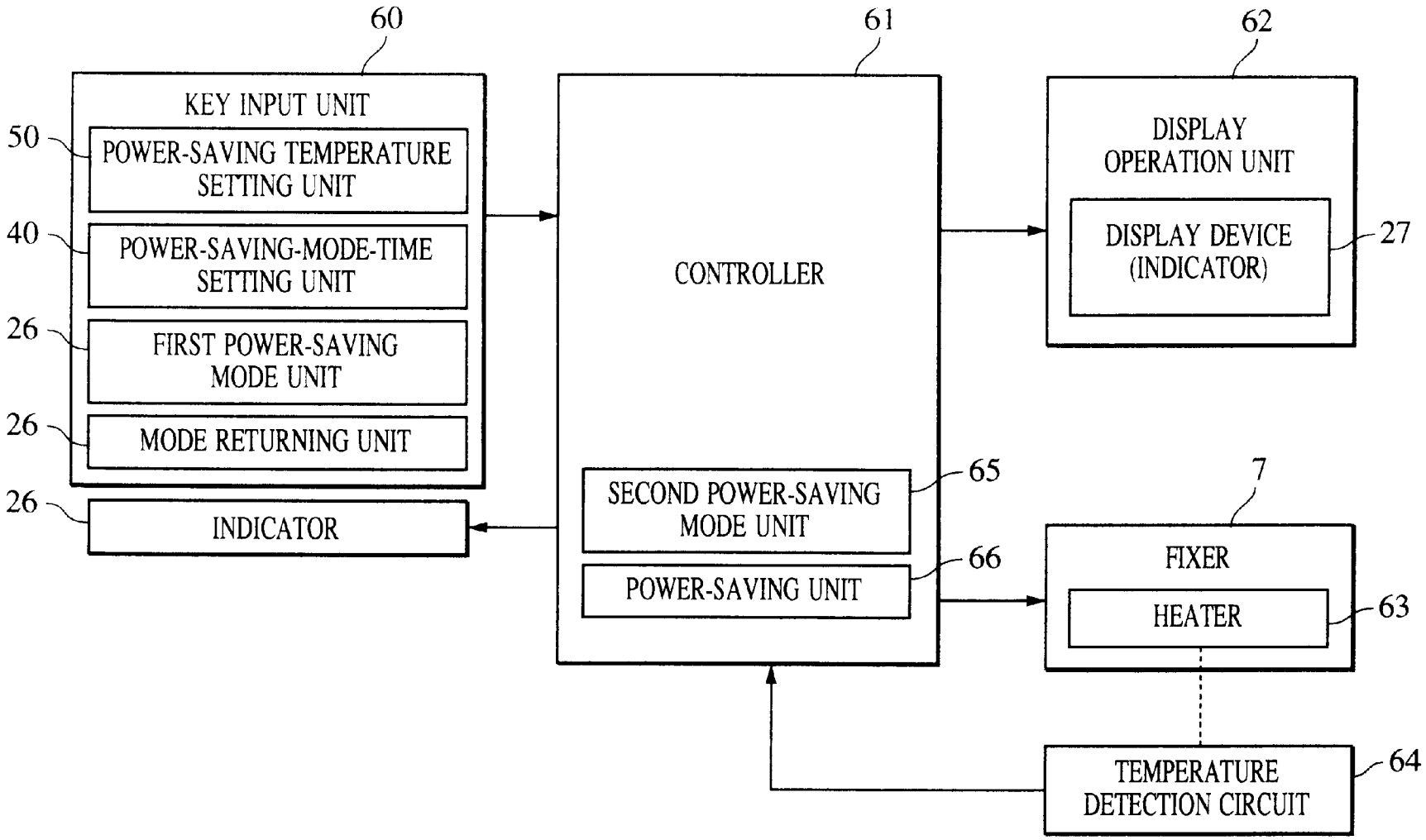
FIG. 6 is a block diagram showing a power-saving controller.

FIG. 6 shows a block diagram of a system for controlling power saving of the image-forming apparatus shown in FIG. 1. The system includes a key input unit 60 composed of keys 22 to 28 including the power-saving key 26, the power-saving-mode-time setting key 52 provided in the power-saving-timer setting window (power-saving-mode-time setting unit) 50, power-saving-factor setting keys 41 provided in the power-saving-factor setting window 40, etc. Each key output is supplied, stored, and processed in the controller 61, which includes a microcomputer and a storage unit.

The power-saving key 26 functions as the first power-saving mode unit for changing the mode of the image-forming apparatus from its standby mode into its power-saving mode, or as a mode-returning unit for returning the mode of the image-forming apparatus to its standby mode. The LED in the power-saving key 26 flashes orange when the image-forming apparatus is in its power-saving mode, whereby functioning as an indicator.

The system includes a display operation unit 62 including the display device 27. A signal for driving the display operation unit 62 is supplied by the controller 61. The driving of the display operation unit 62 is switched off to deactivate the display device 27, whereby the display operation unit 62 functions as an indicator.

The fixer 7 includes a heater 63. The temperature of the heater 63 is detected by a temperature detection circuit 64 in which a known thermistor is used. A detection signal from the temperature detection circuit 64 is supplied to the controller 61.

A power-saving unit 66 sets the temperature of the heater 63 obtained in the power-saving mode at a control temperature lower than a control temperature obtained in the standby mode, and controls the supply of power to the heater 63 based on the temperature data detected by the temperature detection circuit 64, whereby a low control temperature is used to activate a power-saving mode in which consumption power is reduced.

A second power-saving mode unit 65 automatically changes the mode of the image-forming apparatus into its power-saving mode when no operation is performed in the power-saving time set in the power-saving-factor setting window (power-saving-mode-time setting unit) 40.

Figures 7, 7A:
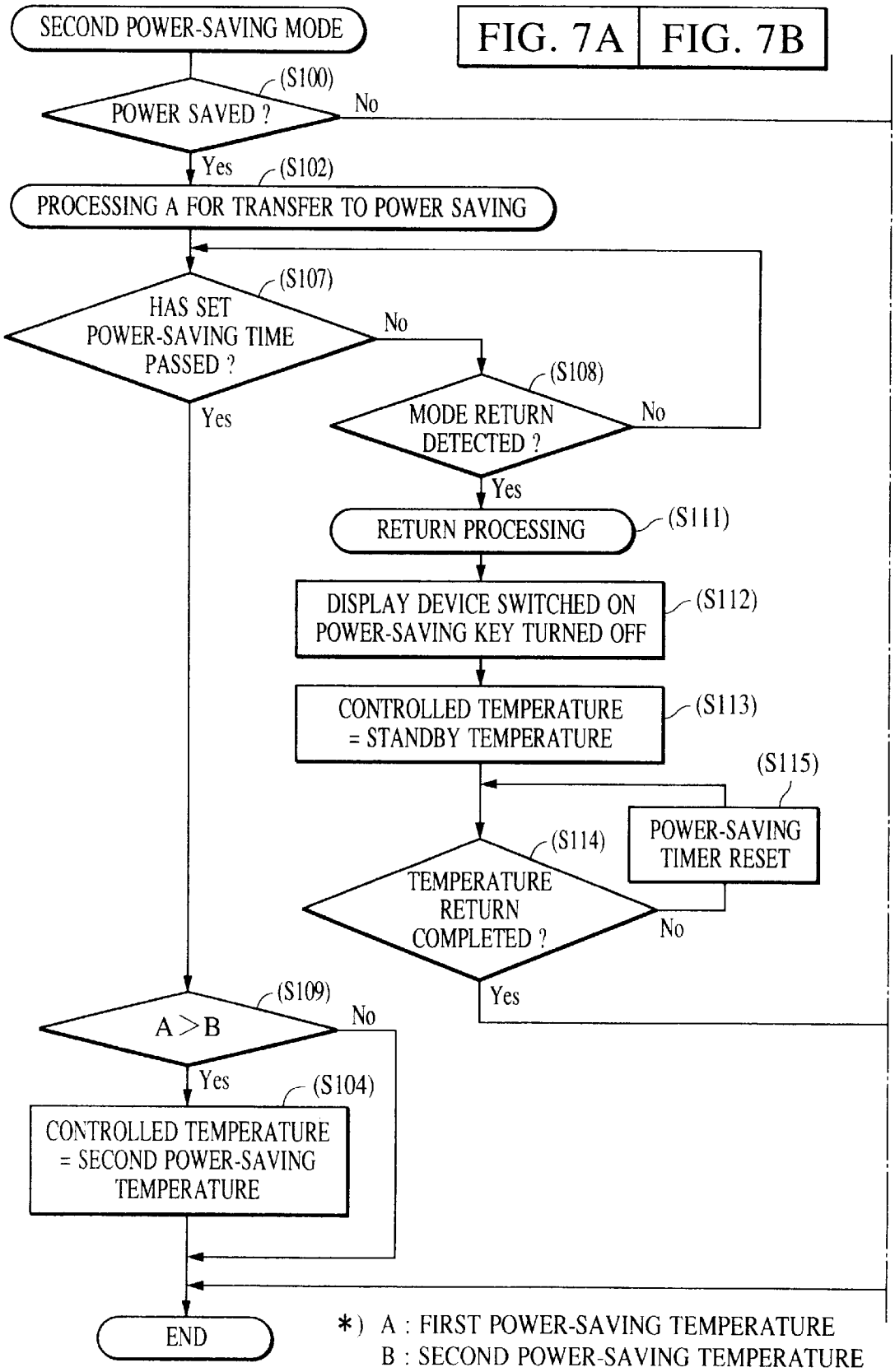
FIG. 7 is a flowchart illustrating power-saving processing.
Figure 7B:
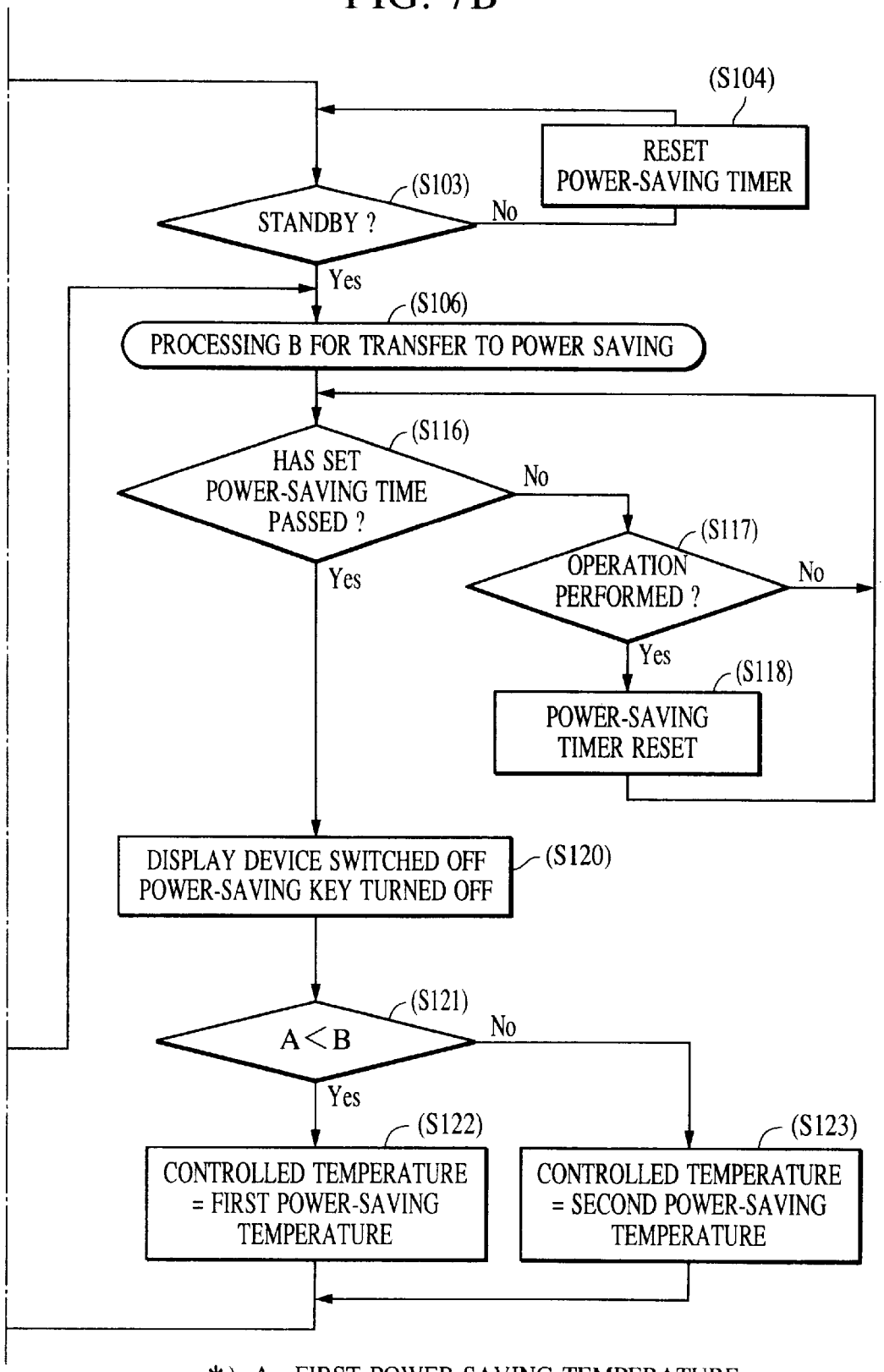

FIG. 7 is a flowchart showing a process for controlling transfer to the second power-saving mode using the second power-saving mode unit 65 of the image-forming apparatus according to the present invention.

In step S100, the process determines whether the image-forming apparatus is in its power-saving mode. If it has been in its power-saving mode, its power-saving mode is maintained, and in step S102, processing A for transfer to power-saving control is performed. If the image-forming apparatus is not in its power-saving mode, the process proceeds to step S103.

In step S103, the process determines whether the image-forming apparatus stands by. If it stands by, processing B for transfer to power-saving control starts in step S106. If it does not stand by (for example, a returning operation is being performed by the fixer 7), a power-saving timer for measuring a period in which no operation is performed in the standby mode is reset until the standby mode becomes activated.

[Processing A for Transfer to Power-Saving Mode]

Processing A starting in step S102 is control of transfer to power-saving mode in the case where the image-forming apparatus stands by and has already been in its power-saving mode (first power-saving mode) with the pressing of the power-saving key 26.

In step S107, the process determines whether the power-saving timer, which starts measuring when the power-saving mode is activated by the first power-saving mode unit, has measured the time of transfer to power-saving mode set in the power-saving-timer setting window 50.

In step S108, until the power-saving timer finishes measuring, the process always verifies whether the power-saving key 26 is pressed to request mode returning. If mode returning is requested, the process proceeds to step S111 in which return processing starts.

In step S109, the process verifies whether a first power-saving temperature (control temperature selected by the user), used when a power-saving mode (first power-saving mode) is activated by the first power-saving mode unit, is set to be higher than a second power-saving temperature used when a power-saving mode (second power-saving mode) is activated. (At this time, the control temperature is set at the first power-saving temperature) The second power-saving temperature is set to be higher than a control temperature corresponding to a maximum power-saving factor capable of being set by the power-saving-facto:r setting key 41 and to be lower than a control temperature corresponding to a minimum power-saving factor. If the first power-saving temperature is higher than the second power-saving temperature, the process proceeds to step S110.

In step S110, the control temperature is set at the second power-saving temperature in order that the present mode may be changed into a power-saving mode providing more power-saving effects.

[Return Processing]

The return processing starting in step S111 is control of mode returning from the power-saving mode of the image-forming apparatus to its standby mode.

In step S112, the display device 27 and the power-saving key 26 are switched off, whereby the deactivation of the power-saving mode is indicated to the user.

In step S113, the temperature of the fixer 7 is set at a control temperature (standby temperature) obtained when the image-forming apparatus stands by.

In step S114, the process determines using the temperature detection circuit 64 whether the temperature of the heater 8 has reached the standby temperature. If the temperature of the heater 8 has reached the standby temperature, and temperature returning is complete, the process proceeds to a step between steps 103 and 106 in which the image-forming apparatus stands by. While temperature returning is being performed, the power-saving timer is reset in step S115.

Steps S111 to S113 are securely performed in the return from the power-saving mode.

[Processing B for Transfer to Power-Saving Mode]

Processing B starting in step S106 is control of transfer to power-saving mode, which is performed by the second power-saving mode unit in the standby mode.

In step S116, the process determines whether the power-saving timer, which starts measuring when an operation of the image-forming apparatus is last performed, has measured the power-saving time set in the power-saving-timer setting window 50.

In step S117, until the power-saving timer finishes measuring, the process always verifies whether an operation of the image-forming apparatus is performed. If the operation has been performed, in step S118, the power-saving timer is initialized. If the power saving has finished measuring with no operation performed, the process proceeds to step S120.

In step S120, the display device 27 and the power-saving key 26 are switched off, whereby the activation of the power-saving mode is indicated to the user.

In step S121, by comparing the first power-saving temperature (control temperature selected by the user) used when the first power-saving mode unit: activates power saving, and the second power-saving temperature used when the second power-saving mode unit activates power saving, a power-saving temperature at which larger power-saving effects can be obtained is determined. In other words, if the first power-saving temperature (control temperature selected by the user) is lower than the second power-saving temperature, the process proceeds to step S122. If it is higher, the process proceeds to step S123.

In step S122, the control temperature is set at the first power-saving temperature.

In step S123, the control temperature is set at the second power-saving temperature.

As described above, by using two units, namely, a second power-saving mode unit that automatically changes the mode of an image-forming apparatus into its power-saving mode when no operation is performed in a predetermined period in its standby mode, and a first power-saving mode unit for a user to arbitrarily change the mode of the image-forming apparatus from its standby mode into its power-saving mode, effective power-saving control can be obtained.

In addition, in the case where no operation is performed in a predetermined period, a second power-saving mode unit automatically sets a power-saving temperature at which power saving is effectively performed, whereby most efficient power-saving effects are obtained.

In the foregoing embodiment, the second power-saving temperature is set to be higher than a control temperature capable of being selected by the user at which a power-saving factor is the largest. However, it may be set at the control temperature or less. In this case, steps S109, S121, and S122 are not used, and the second power-saving temperature ma y unconditionally be set.

The present invention is not limited to the foregoing embodiment, but may be variously modified.

What is claimed is:

1. A power-saving controller comprising:

temperature detection means for detecting the temperature of a heating load used in an image-forming apparatus;

temperature control means for controlling the driving of said heating load based on an output from said temperature detection means;

a power-saving key for instructing transfer to a power-saving mode in which said heating load is controlled to have a power-saving temperature lower than a target temperature of said heating load used when said image-forming apparatus stands by;

selecting means for manually selecting the power-saving temperature of said heating load in the power-saving mode; and power-saving control means for controlling said temperature control means so that said heating load is controlled to have the power-saving temperature selected by said selecting means when an instruction for performing transfer to the power-saving mode is input by said power-saving key, wherein when the power-saving temperature selected by said selecting means is higher than a predetermined temperature, said power-saving control means controls said heating load so that said heating load is controlled to have the predetermined temperature, after a predetermined period elapses in the power-saving mode.

2. A power-saving controller according to claim 1, wherein when said image-forming apparatus is not operated in a predetermined period while not having the power-saving mode, said power-saving control means controls said temperature control means so that said heating load is controlled to have the predetermined temperature.

3. A power-saving controller according to claim 1, wherein said heating load is a fixer used in said image-forming apparatus.

4. A power-saving controller comprising:

temperature detection means for detecting the temperature of a heating load used in an image-forming apparatus;

temperature control means for controlling the driving of said heating load based on an output from said temperature detection means;

selecting means for manually selecting a target temperature of said heating load in a power-saving mode in which said heating load is controlled to have a power-saving temperature lower than a target temperature of said heating load used when said image-forming apparatus stands by; and power-saving control means for controlling said temperature control means so that after said image-forming apparatus is not operated in a predetermined period while not having the power-saving mode, the power-saving mode is activated, when the power-saving temperature selected by said selecting means is lower than a predetermined temperature, said heating load is controlled to have the selected power-saving temperature, and when the selected target temperature is higher than the predetermined temperature, said heating load is controlled to have the predetermined temperature.

5. A power-saving controller according to claim 4, further comprising a power-saving key for inputting an instruction for performing transfer to the power-saving mode, wherein when said image-forming apparatus stands by, and an instruction for performing transfer to the power-saving mode is input by said power-saving key, said power-saving control means controls said temperature control means so that said heating load is controlled to have the selected target temperature.

6. A power-saving controller according to claim 4, wherein said heating load is a fixer used in said image-forming apparatus.

7. A power-saving control method comprising the steps of:

(a) detecting the temperature of a heating load used in an image-forming apparatus;

(b) controlling the temperature of said heating load based on the temperature detected in step (a);

(c) determining whether or not an instruction to perform transfer to a power-saving mode is input, the power-saving mode being such that said heating load is controlled to have a power-saving temperature lower than a target temperature of said heating load used when said image-forming apparatus stands by;

(d) storing the target temperature of said heating load in the power-saving mode, the power-saving temperature being manually selected by an operator;

(e) activating the power-saving mode when an instruction to perform transfer to the power-saving mode is input before controlling said heating load to have the selected power-saving temperature; and (f) controlling said heating load to have a predetermined temperature after a predetermined period elapses in the power-saving mode, and the power-saving temperature stored in step (d) is higher than the predetermined temperature.

8. A power-saving control method according to claim 7, further comprising the step of controlling said heating load to have the predetermined temperature when said image-forming apparatus is not operated in a predetermined period while not having the power-saving mode.

9. A power-saving control method according to claim 7, wherein said heating load is a fixer used in said image-forming apparatus.

10. A power-saving control method comprising the steps of:

(a) detecting the temperature of a heating load used in an image-forming apparatus;

(b) controlling the temperature of said heating load based on the temperature detected in step (a);

(c) storing a target temperature of said heating load in a power-saving mode in which said heating load is controlled to have a power-saving temperature lower than a target temperature of said heating load used when said image-forming apparatus stands by, the target temperature being manually selected by an operator; and (d) activating the power-saving mode after said image-forming apparatus is not operated in a predetermined period while not having the power-saving mode, and performing control so that when the power-saving temperature stored in step (c) is lower than a predetermined temperature, said heating load is controlled to have the stored power-saving temperature, and when the target temperature stored in step (c) is higher than the predetermined temperature, said heating load is controlled to have the predetermined temperature.

11. A power-saving control method according to claim 10, further comprising the steps of:

determining whether or not a power-saving key for instructing the power-saving mode is operated; and controlling said heating load to have the target temperature stored in step (c) based on the determination that said image-forming apparatus is operated with said power-saving key while standing by.

12. A power-saving control method according to claim 10, wherein said heating load is a fixer used in said image-forming apparatus.

13. A power-saving controller comprising:

temperature detection means for detecting the temperature of a heating load used in an image-forming apparatus;

temperature control means for controlling the driving of said heating load based on an output from said temperature detection means;

selecting means for manually selecting the power-saving temperature of said heating load in a power-saving mode, lower than a target temperature of said heating load used when said image-forming apparatus stands by; and power-saving control means for controlling said temperature control means so that said heating load is controlled to have the power-saving temperature selected by said heating means when an instruction for performing transfer to the power-saving mode is input by said power-saving key, wherein when the power-saving temperature selected by said selecting means is higher than a predetermined temperature, said power-saving control means controls said heating load so that said heating load is controlled to have the predetermined temperature, after a predetermined period elapses in the power-saving mode.

14. A power-saving controller according to claim 13, wherein when said image-forming apparatus is not operated in a predetermined period while not having the power-saving mode, said power-saving control means controls said temperature control means so that the heating load is controlled to have the predetermined temperature.

15. A power-saving controller according to claim 13, wherein the heating load is a fixer used in said image forming apparatus.

16. A power-saving control method comprising the steps of:

(a) detecting the temperature of a heating load used in an image-forming apparatus;

(b) controlling the temperature of the heating load based on the temperature detected in step (a);

(c) storing the target temperature of the heating load in the power-saving mode, the power-saving temperature being manually selected by an operator;

(d) activating the power-saving mode when an instruction to perform transfer to the power-saving mode is input before controlling the heating load to have the selected power-saving temperature; and (e) controlling the heating load to have a predetermined temperature after a predetermined period elapses in the power-saving mode, and the power-saving temperature stored in step (c) is higher than the predetermined temperature.

17. A power-saving control method according to claim 16, further comprising the step of controlling the heating load to have the predetermined temperature when the image-forming apparatus is not operated in a predetermined period while not having the power-saving mode.

18. A power-saving control method according to claim 16, wherein the heating load is a fixer used in the image-forming apparatus.

* * * * *

UNITED STATES PATENT AND TRADEMARK OFFICE

CERTIFICATE OF CORRECTION

PATENT NO. : 6,166,355
DATED : December 26, 2000
INVENTOR(S) : Naoto Watanabe et al.

It is certified that error appears in the above-identified patent and that said Letters Patent is hereby corrected as shown below:

Sheet No. 6,
Figure 7A, "(S104)" should read -- (S110) --.

Column 1,
Line 41, "an-aspect" should read -- an aspect --.

Column 2,
Line 23, "that" should read -- than --.

Column 4,
Line 12, "keys." should read -- keys --.

Column 5,
Line 44, "power-saving-facto:r" should read -- power-saving-factor --.

Column 6,
Line 27, "unit:" should read -- unit --.
Line 60, "ma y" should read -- may --.

Signed and Sealed this

First Day of January, 2002

*Attest:*

*Attesting Officer*

JAMES E. ROGAN
*Director of the United States Patent and Trademark Office*